US010739720B2

(12) United States Patent
Kondo

(10) Patent No.: US 10,739,720 B2
(45) Date of Patent: Aug. 11, 2020

(54) IMAGE FORMING APPARATUS

(71) Applicant: CANON KABUSHIKI KAISHA, Tokyo (JP)

(72) Inventor: Shunsaku Kondo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/667,503

(22) Filed: Oct. 29, 2019

(65) Prior Publication Data

US 2020/0133191 A1 Apr. 30, 2020

(30) Foreign Application Priority Data

Oct. 29, 2018 (JP) ..... 2018-202900

(51) Int. Cl.
*G03G 15/00* (2006.01)
*G03G 21/16* (2006.01)
*G03G 15/04* (2006.01)

(52) U.S. Cl.
CPC ... *G03G 21/1647* (2013.01); *G03G 15/04054* (2013.01)

(58) Field of Classification Search
CPC ..... G03G 15/04054; G03G 21/1647; G03G 21/1652; G03G 21/1661; G03G 21/1642
See application file for complete search history.

(56) References Cited

U.S. PATENT DOCUMENTS

| | | | | |
|---|---|---|---|---|
| 8,311,437 | B2 | 11/2012 | Sato | |
| 8,521,061 | B2 | 8/2013 | Sato | |
| 8,594,530 | B2 * | 11/2013 | Sato | G03G 21/1633 399/107 |
| 8,774,673 | B2 | 7/2014 | Sato et al. | |
| 8,831,461 | B2 | 9/2014 | Sato | |
| 9,122,238 | B2 | 9/2015 | Sato et al. | |
| 9,176,463 | B2 | 11/2015 | Sato | |
| 10,025,257 | B2 | 7/2018 | Sato | |

FOREIGN PATENT DOCUMENTS

| | | |
|---|---|---|
| JP | 2009-157135 A | 7/2009 |
| JP | 2012-144019 A | 8/2012 |
| JP | 2012-145884 A | 8/2012 |

* cited by examiner

*Primary Examiner* — Hoang X Ngo
(74) *Attorney, Agent, or Firm* — Venable LLP

(57) ABSTRACT

An image forming apparatus includes a main assembly and a drawer unit. The drawer unit includes a photosensitive drum, an optical print head, first to third wall portions and a relay substrate. The main assembly includes a first facing portion, a second facing portion and a main assembly substrate. The relay substrate and the main assembly substrate are connected by a cable folded back at the rear of the third wall portion. A distance between a portion of the cable before being folded back and a portion of the cable after being folded back is longer than a distance, with respect to a longitudinal direction of the optical print head, between the first or second wall portion on which the relay substrate is provided and the first or second facing portion facing the first or second wall portion on which the relay substrate is provided.

11 Claims, 10 Drawing Sheets

(b)

(a)

(a)

(b)

(c)

(a)

(b)

IMAGE FORMING APPARATUS

FIELD OF THE INVENTION AND RELATED ART

The present invention relates to an image forming apparatus for forming an image by using an optical print head.

In a printer which is an image forming apparatus of the electrophotographic type, the following light exposure type has been known in general. That is, a light exposure type in which a photosensitive drum is exposed to light by using a light exposure head such as a light emitting diode (LED) or an organic electroluminescence (EL) element and a latent image is formed has been known in general. The exposure head includes a light emitting element array arranged in a longitudinal direction of the photosensitive drum and a rod lens array for forming an image on the photosensitive drum with light from the light emitting element array. As regards the LED or the organic EL element, a constitution having a surface (planar) emitting shape such that an irradiation direction of light from a light emitting surface is the same direction as the rod lens array has been known. Here, a length of the light emitting element array is determined depending on a width of an image forming region on the photosensitive drum, and an interval between light emitting elements is determined depending on resolution of the printer. For example, in the case of the printer of 1200 dpi in resolution, a pixel interval is 21.16 μm, and therefore, the interval between the light emitting elements is also an interval corresponding to 21.16 μm. In the printer using such an exposure head, compared with a printer of a laser scanning type in which the photosensitive drum is scanned with a laser beam deflected by a rotatable polygonal mirror, the number of component parts is small, and therefore, downsizing and cost reduction of the printer are easy. Further, in the printer using the exposure head, noise generating by rotation of the rotatable polygonal mirror is reduced.

Further, in the image forming apparatus of the electrophotographic type, a constitution in which an image forming unit accommodating an image forming portion such as a developing device, a photosensitive drum and the like is capable of being drawn out to an outside of the image forming apparatus in order to perform exchange of consumables such as toner and the photosensitive drum and to perform a maintenance operation is employed. The drawing-out of the image forming unit is enabled, so that access to respective devices accommodated in the image forming unit is made easy and thus the maintenance operation is facilitated.

Parts (a) and (b) of FIG. 10 are top (plan) views of a printer 100 having such a constitution. Part (a) of FIG. 10 is a schematic view showing a state in which an image forming unit 502 which supports and accommodates a plurality of photosensitive drums 102 and a plurality of light exposure heads 106 for exposing the photosensitive drums to light is accommodated in the printer 100. At positions facing side surfaces of the image forming unit 502 on both sides, guiding members 506 are fixed to the printer 100, and outside one of the guiding members 506, an image controller 503 for controlling image formation on the photosensitive drums 102 is mounted. The image controller 503 is connected through a flat cable 520 to an LED emission controller 504 for controlling the exposure heads 106 provided in the image forming unit 502. Then, image data from the image controller 503 are outputted to the exposure heads 106 through the LED emission controller 504. Part (b) of FIG. 10 is a schematic view showing a state in which the image forming unit 502 is drawn out to an outside of the printer 100. In part (b) of FIG. 10, the image forming unit 502 is drawn out along the guiding members 506, and the LED emission controller 504 provided to the image forming unit 502 is also drawn out together with the image forming unit 502. At this time, the flat cable 520 connected to the LED emission controller 504 is also drawn out while maintaining electrical connection by being bent (Japanese Laid-Open Patent Application (JP-A) 2012-14409).

The flat cable 520 connecting the image controller 503 and the LED emission controller 504 is slid with drawing-out and insertion of the LED emission controller 504 in a bent state. In general, the flat cable 520 causes a difference in durability depending on a bending radius R thereof. For example, in sliding in the bending radius R of 10 mm, durability of 30,000 times or more is obtained, while in sliding in the bending radius R of 5 mm, durability is 10,000 times, and in sliding in the bending radius R of 3 mm, durability of only about 1,000 times is obtained. That is, the flat cable 520 lowers in durability with a decreasing bending radius R. In the constitution of JP-A 2012-144019, as shown in part (a) of FIG. 10, in the case where the image forming unit 502 is inserted into the printer 100, a bent portion 550 of the flat cable 520 is formed in a space between the guiding member 506 and the image forming unit 502. For that reason, the bending radius of the bent portion 550 is determined by this space, and therefore, it is difficult to ensure a sufficient bending radius. When the space between the guiding member 506 and the image forming unit 502 is intended to be made small for downsizing a main assembly of the printer 100, the bending radius of the bent portion 550 of the flat cable 520 has to be made smaller. Further, when the bending radius of the flat cable 520 is made small the flat cable 520 is liable to be broken, so that the durability lowers.

SUMMARY OF THE INVENTION

According to an aspect of the present invention, there is provided an image forming apparatus comprising: a main assembly; and a drawer unit movable between a mounted position where the drawer unit is mounted in the main assembly and a drawn-out position where the drawer unit is drawn out of the mounted position, wherein the drawer unit comprises a rotatable photosensitive drum, an optical print head including a light emitting element configured to expose the photosensitive drum to light, first, second and third wall portions, wherein the first wall portion supports one end side of the optical print head with respect to a longitudinal direction of the optical print head, the second wall portion supports the other end side of the optical print head with respect to the longitudinal direction, and the third wall portion is continuously formed between an upstream end portion of the first wall portion and an upstream end portion of the second wall portion with respect to a drawing out direction of the drawer unit from the mounted position toward the drawn-out position to form a wall portion in cooperation with the first wall portion and the second wall portion, and a relay substrate provided on either one of an outer surface of the first wall portion and an outer surface of the second wall portion with respect to the longitudinal direction and configured to relay a signal for driving the optical print head, wherein the main assembly comprises a first facing portion provided on a side opposite from a side facing the second wall portion and configured to face the first wall portion, a second facing portion provided on a side opposite from a side facing the first wall portion and configured to face the second wall portion, and a main assembly substrate configured to generate a driving signal for driving the light emitting element, wherein the relay substrate and the main assembly substrate are connected by a cable, and when the drawer unit is in the mounted position, the cable extends from the relay substrate in an opposite direction to the drawing-out direction and is folded back in the drawing-out direction on a side downstream of the third wall portion with respect to the opposite direction and then is connected to the main assembly substrate through an opening provided in one of the first facing portion and the second facing portion, facing the relay substrate on a side downstream of the third wall portion with respect to the drawing-out direction, and wherein the cable folded back includes portions with respect to the longitudinal direction on a side upstream with respect to the drawing-out direction, wherein a distance between the portion of the cable before being folded back and the portion of the cable after being folded back is longer than a distance, with respect to the longitudinal direction, between the first or second wall portion on which the relay substrate is provided and the first or second facing portion facing the first or second wall portion on which the relay substrate is provided.

Further features of the present invention will become apparent from the following description of exemplary embodiments with reference to the attached drawings.

BRIEF DESCRIPTION OF THE DRAWINGS

Parts (a) to (c) of FIG. 1 are schematic sectional views each showing a structure of an image forming apparatus of an embodiment.

Part (a) of FIG. 2 is a perspective view for illustrating a positional relationship between a light exposure head and a photosensitive drum in the embodiment, and part (b) of FIG. 2 is a schematic view for illustrating a structure of the exposure head in the embodiment.

Figure 3:
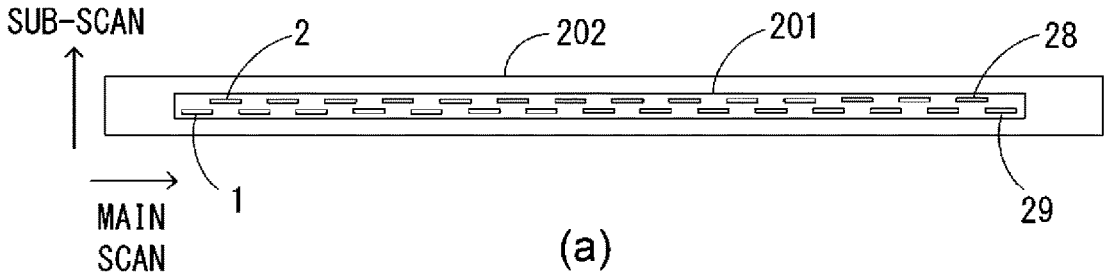
Figure 3:
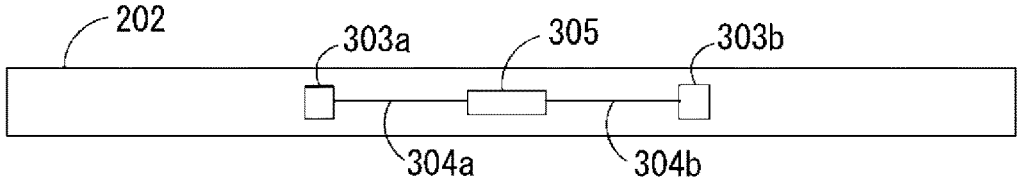
Figure 3:
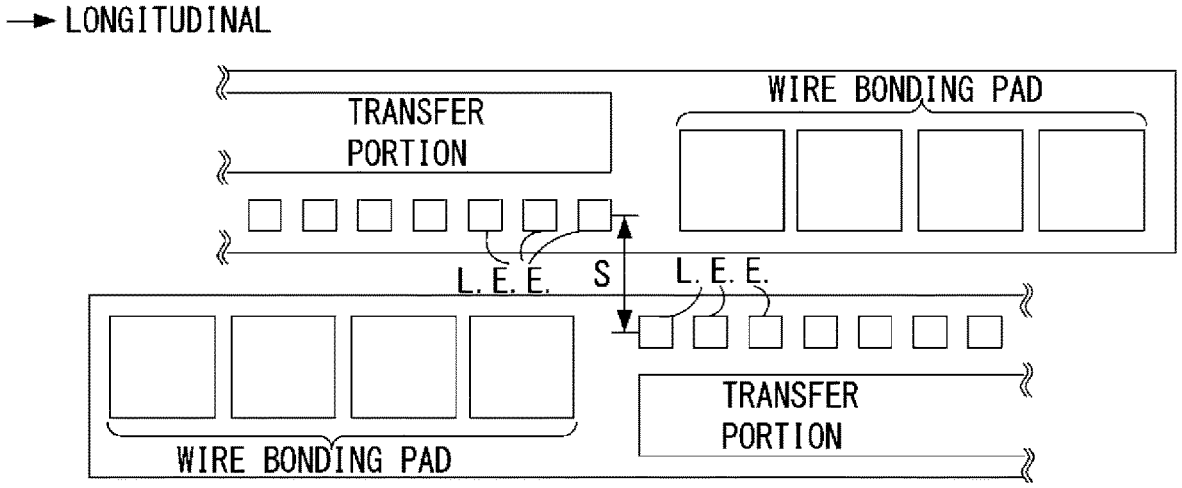

Parts (a) and (b) of FIG. 3 are schematic views each showing a driving substrate in the embodiment, and part (c) of FIG. 3 is a schematic view for illustrating a structure of surface emitting element array chips in the embodiment.

Figure 4:
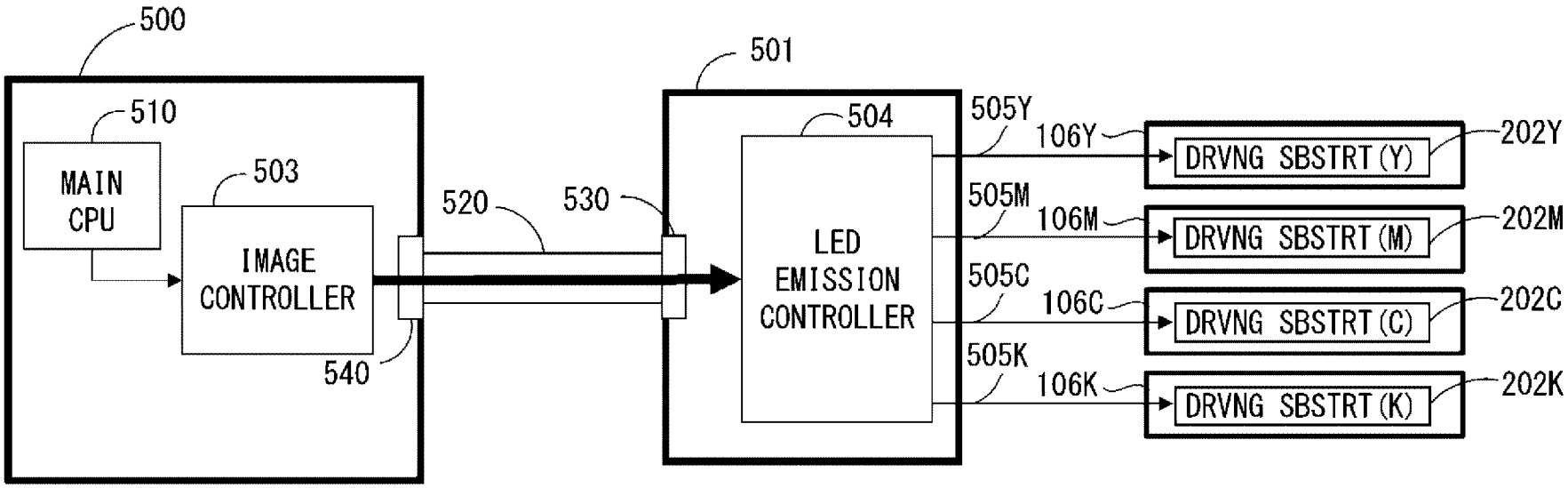

FIG. 4 is a control block diagram of a main assembly substrate, an LED control substrate and a driving substrate in the embodiment.

Figure 5:
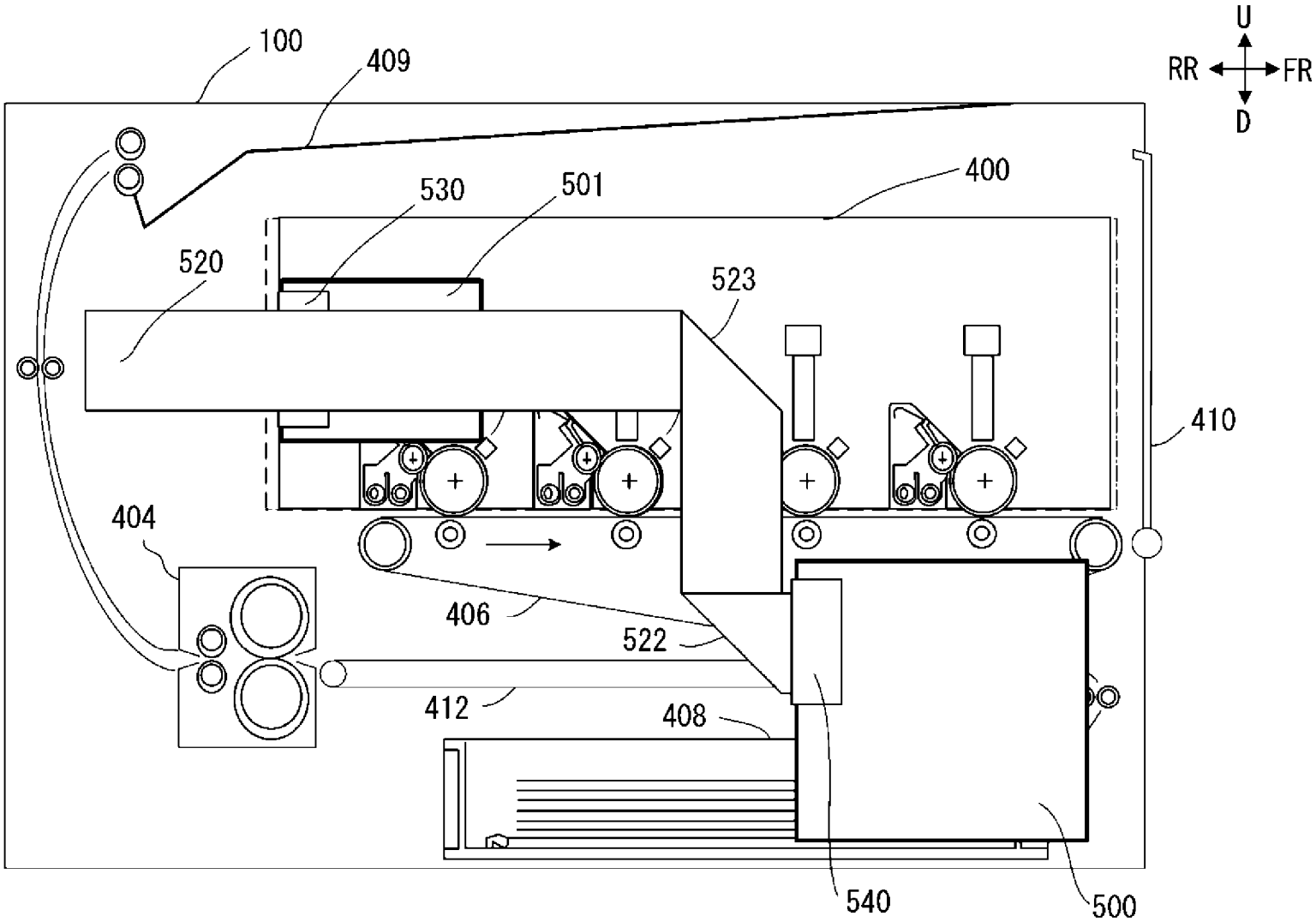

FIG. 5 is a perspective view for illustrating a cable connection structure when a casing in the embodiment is accommodated in a printer.

Figure 6:
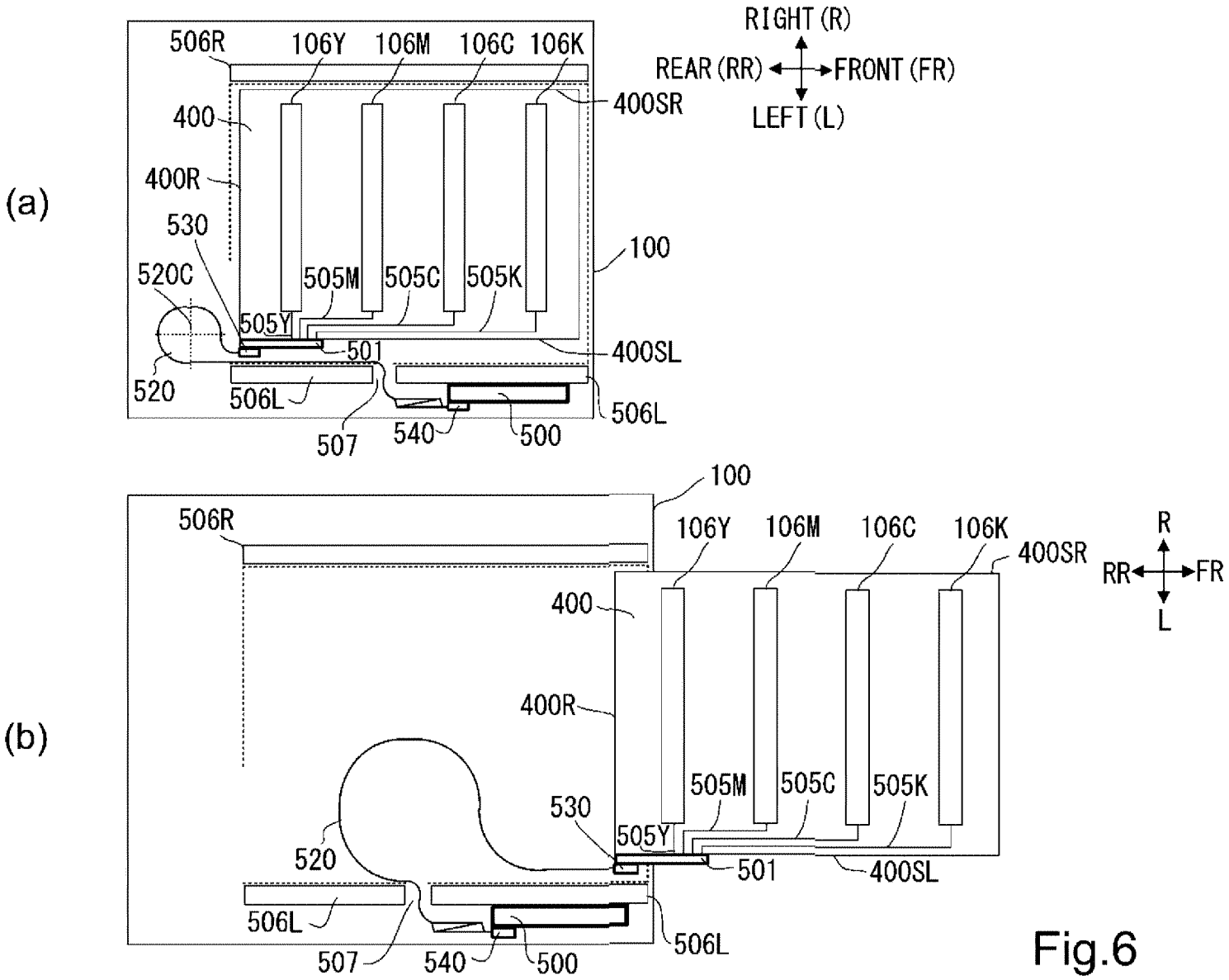

Parts (a) and (b) of FIG. 6 are schematic views showing the cable connection structure when the casing in the embodiment is drawn out and inserted into the printer.

Figure 7:
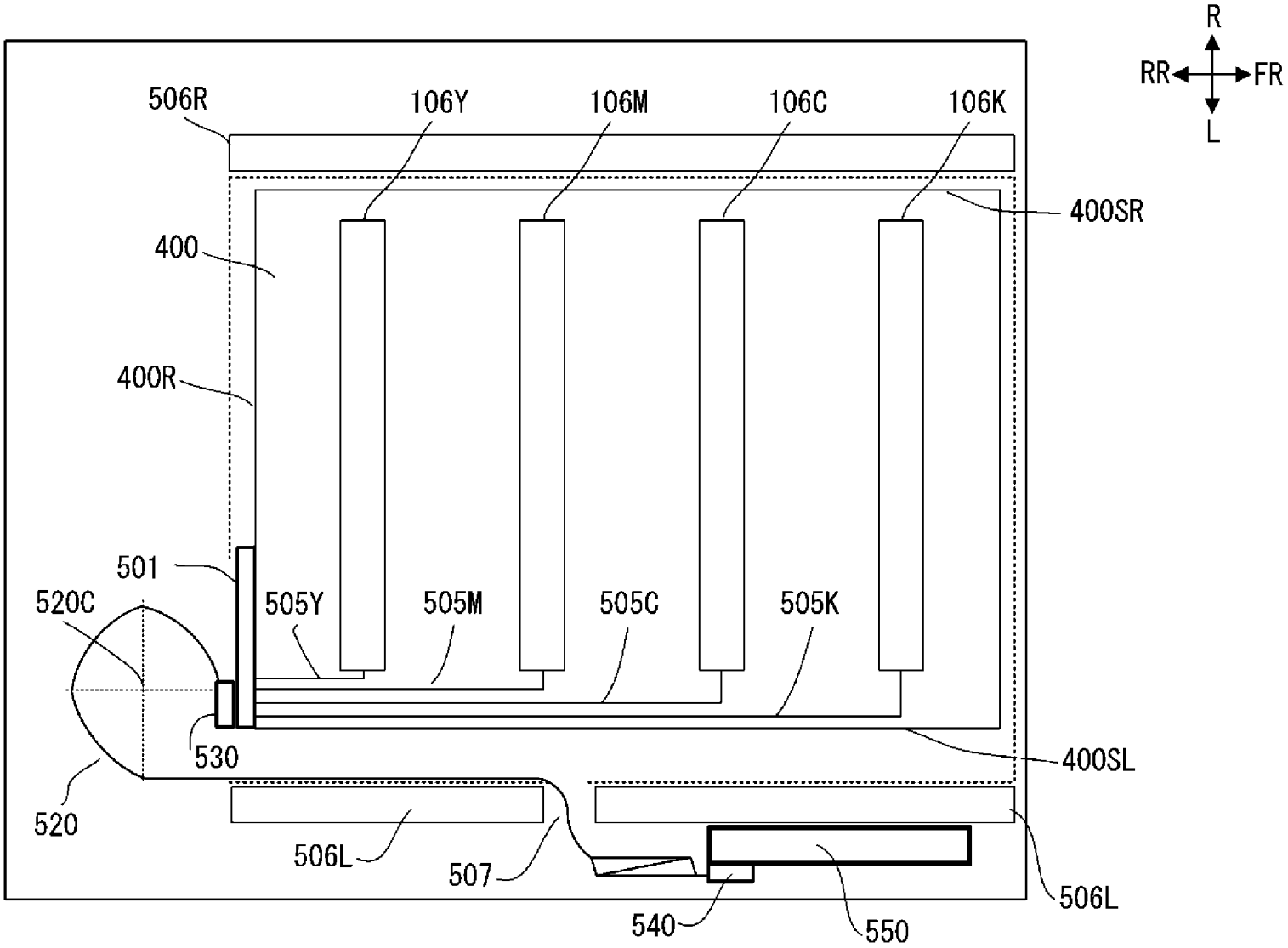

FIG. 7 is a schematic view showing a cable connection structure when the casing in the embodiment is accommodated in the printer.

Figure 8:
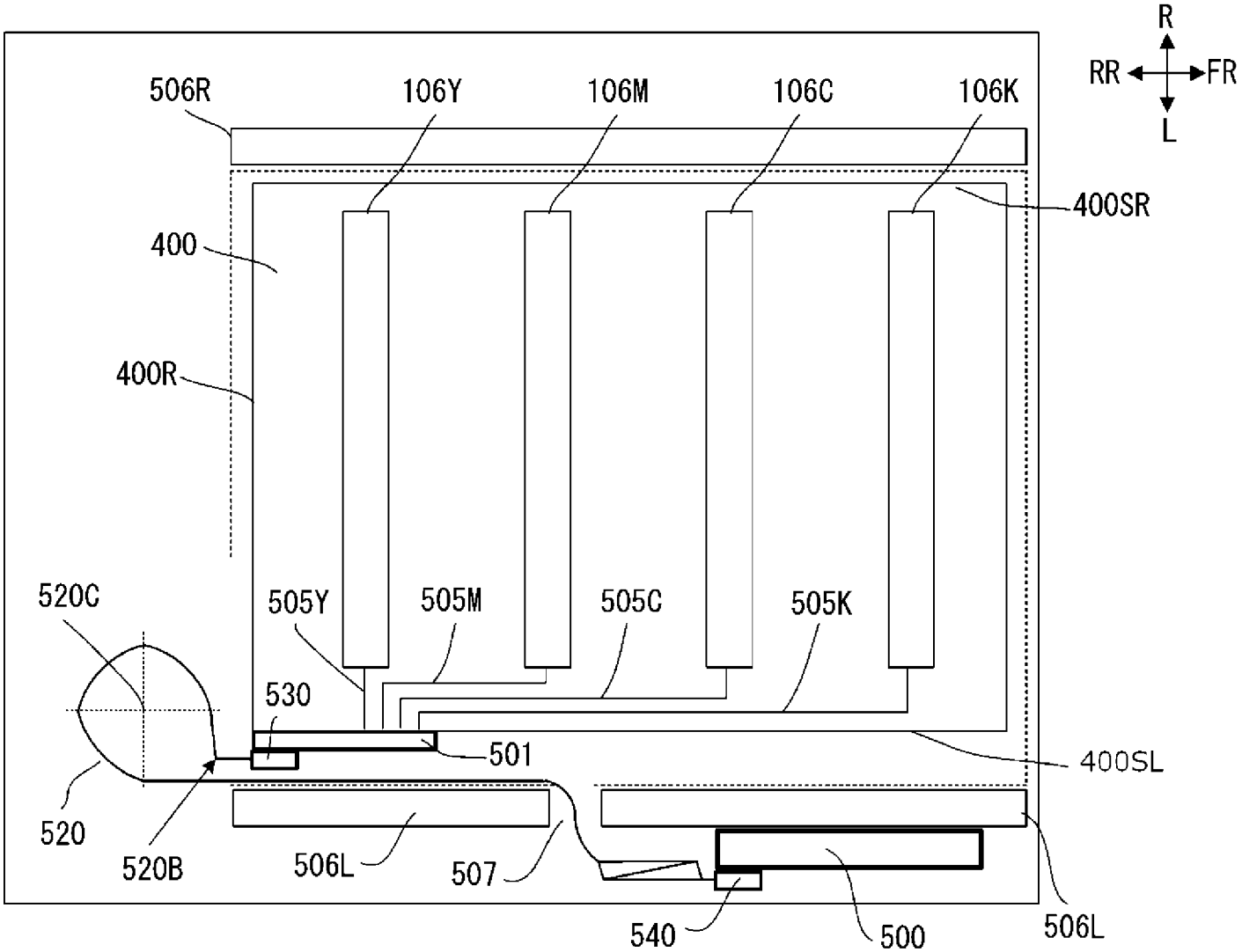

FIG. 8 is a schematic view showing a cable connection structure when the casing in the embodiment is accommodated in the printer.

Figure 9:
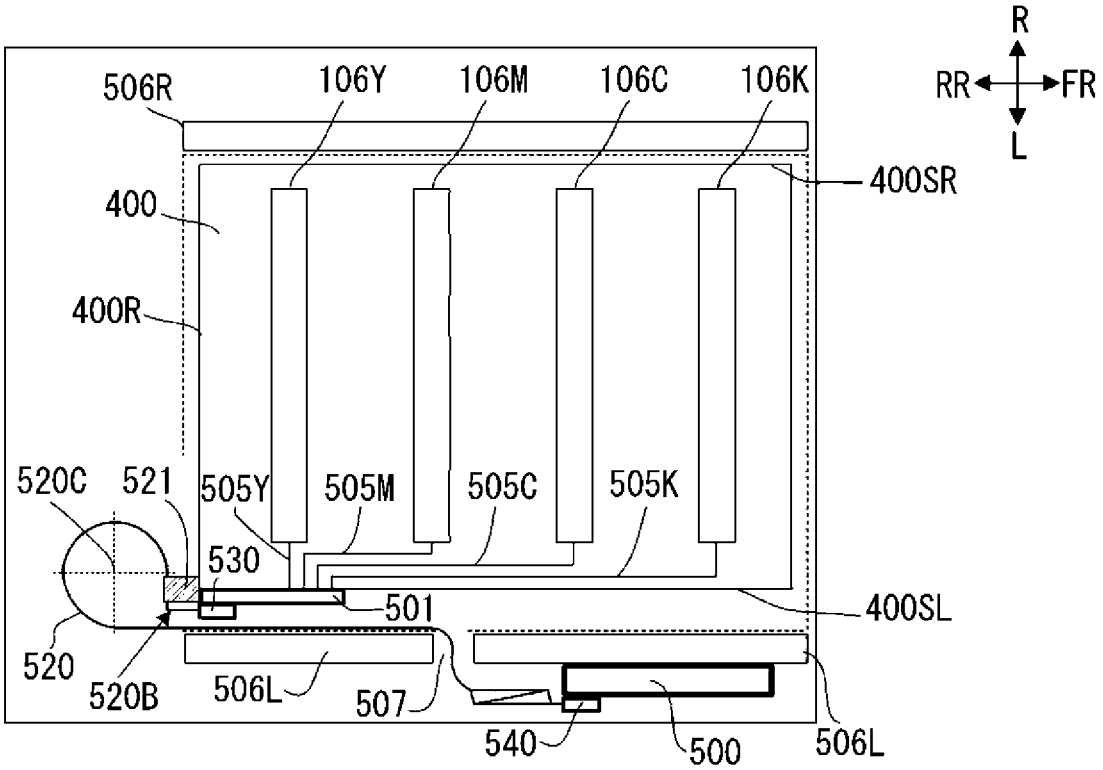
Figure 9:
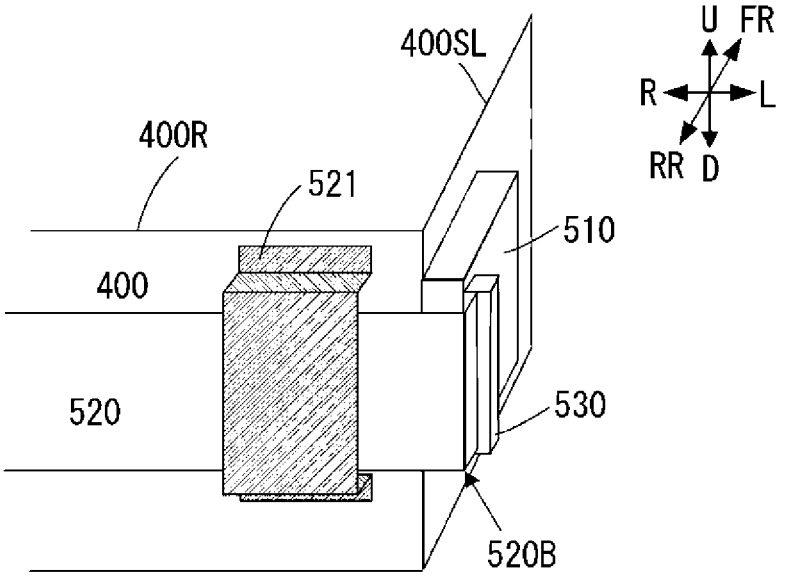

Part (a) of FIG. 9 is a schematic view showing a cable connection structure when the casing in the embodiment is accommodated in the printer, and part (b) of FIG. 9 is an enlarged perspective view the cable connection structure in the neighborhood of a fixing member in the embodiment.

Figure 10:
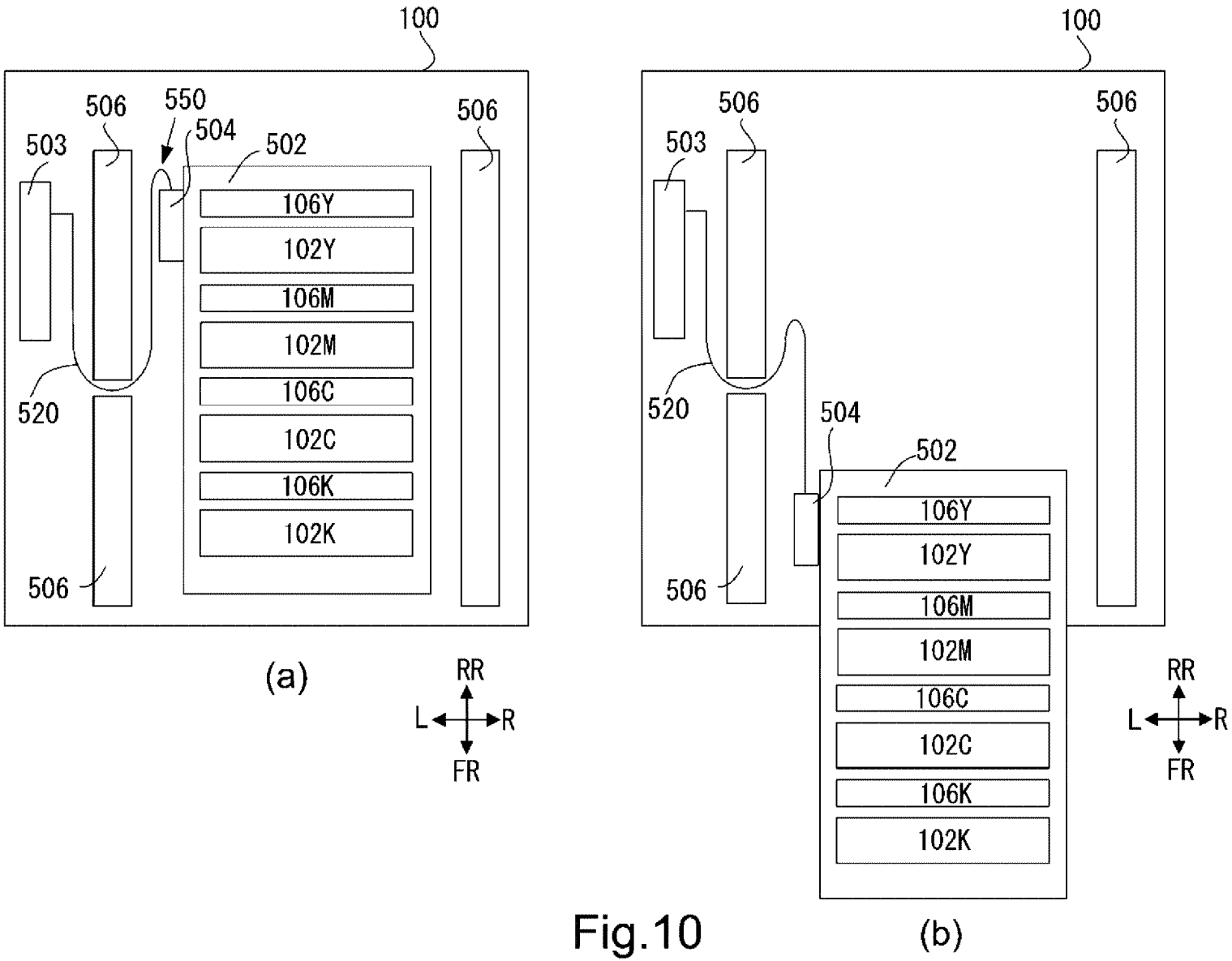

Parts (a) and (b) of FIG. 10 are schematic views each showing a cable connection structure when a casing in a conventional example is drawn out of and inserted into a printer.

DESCRIPTION OF EMBODIMENTS

In the following, embodiments of the present invention will be specifically described with reference to the drawings.

Embodiment 1

[Structure of Image Forming Apparatus]

Figure 1:
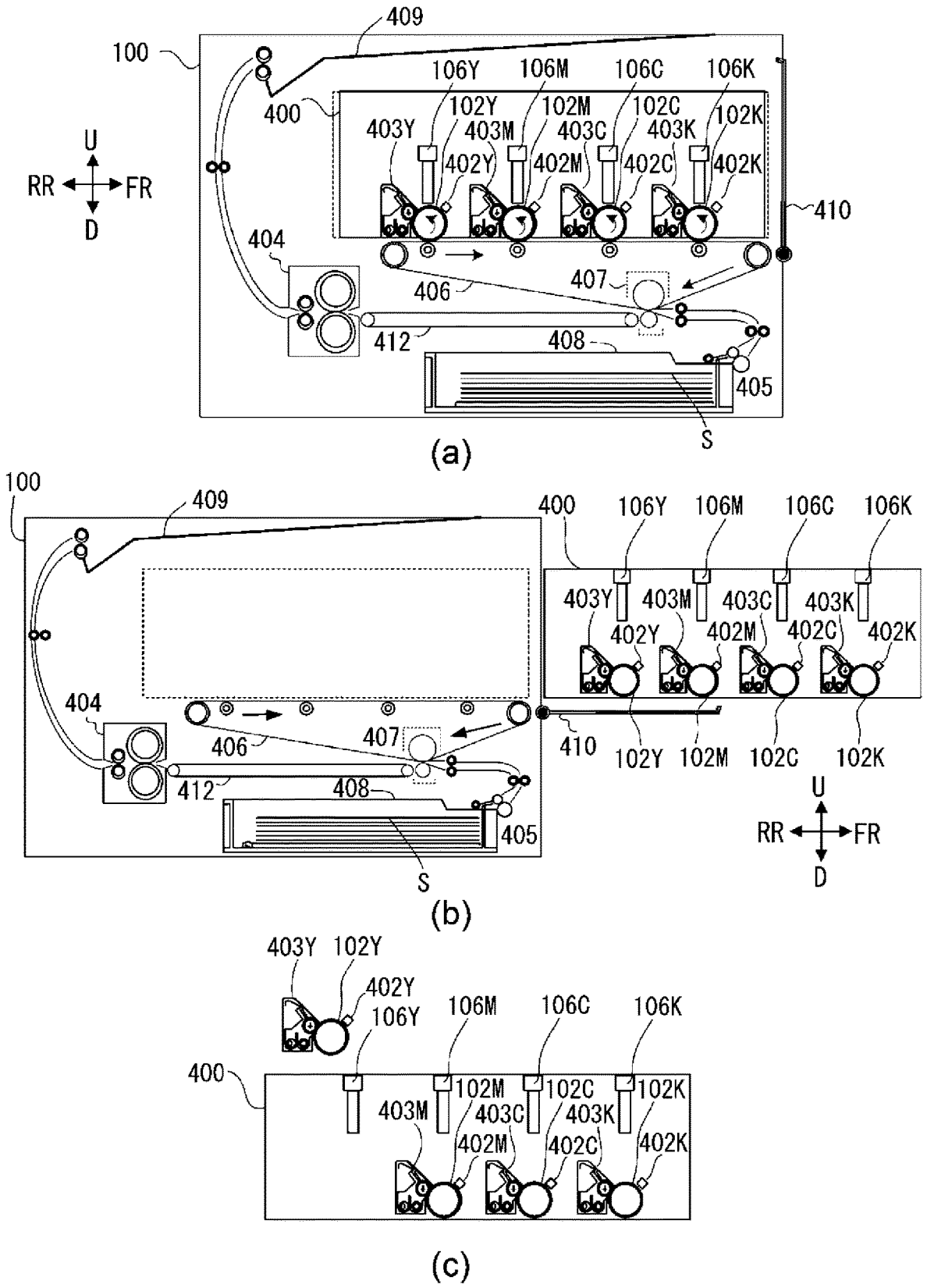

Part (a) of FIG. 1 is a schematic sectional view showing a structure of an image forming apparatus of an electrophotographic type in embodiment 1. A printer 100 which is the image forming apparatus shown in part (a) of FIG. 1 includes a casing 400 (an example of a drawer unit), a fixing portion 404, a sheet (paper) feeding/conveying portion 405, a door 410 for opening and closing a drawing-out opening of the casing 400, and the like. Here, the printer 100 is also referred to as an apparatus main assembly. The image forming apparatus in this embodiment includes the printer 100 which is an example of the apparatus main assembly and includes the casing 400. That is, the casing 400 which is the example of the drawer unit is capable of being mounted in and drawing-out of the printer 100 which is the example of the apparatus main assembly. Part (a) of FIG. 1 is the sectional view showing a state in which the casing 400 is fixed to a mounted position where the casing 400 is mounted in the image forming apparatus. Incidentally, in parts (a) and (b) of FIG. 1, "FR" (right side of the drawing sheet) is a frontward direction of the printer 100, and "RR" (left side of the drawing sheet) is a rearward direction of the printer 100. Further, "U" (upper side of the drawing sheet) is a top (upward) direction of the printer 100, and "D" (lower side of the drawing sheet) is a bottom (downward) direction of the printer 100. Further, also in FIG. 5, the directions indicated by "FR", "U" and "D" are similar to those described above and will be omitted from description.

The casing 400 is a unit which includes therein four process cartridges (image forming portion) of different toner colors of yellow (Y), magenta (M), cyan (C) and black (K) and which is capable of being drawn out of and mounted in the printer 100. The casing 400 includes an open surface which is open upward and an outer periphery thereof is surrounded by side walls. The respective process cartridges have the same constitution, and each process cartridge is constituted by a photosensitive drum 102 rotatable relative to a main assembly (image forming apparatus main assembly) of the printer 100, a charging device 402 and a developing device 403. Further, the exposure head 106 is provided opposed to the photosensitive drum 102 of each process cartridge. One end side of the exposure head 106 with respect to a rotational axis direction of the photosensitive drum 102 is supported by a side wall portion (first wall portion) of the casing 400. Further, also the other side of the exposure head 106 with respect to the rotational axis direction of the photosensitive drum 102 is supported by a side wall portion (second wall portion) of the casing 400. Further, the respective process cartridges are also supported by the two side wall portions supporting the exposure heads 106 and are capable of being accommodated between the two side wall portions.

Incidentally, suffixes Y, M, C and K of reference numerals represent members of the process cartridges for yellow, magenta, cyan and black, respectively. In the following, description of the suffixes will be omitted except for the case where description of a specific process cartridge is made.

When image formation is started, in each of the process cartridges, the charging device 402 electrically charges uniformly a surface of the photosensitive drum 102 rotating an arrow direction (counterclockwise direction) in the figure. Then, the exposure head 106 which is an optical print head causes a chip surface of an LED arrow to emit light depending on the irradiation data from an LED control substrate 501 described later, and the emitted light is condensed at the surface of the photosensitive drum 102 by a rod lens array, so that an electrostatic latent image is formed. The developing device 403 deposits the toner on the electrostatic latent image formed on the photosensitive drum 102, and thus develops the electrostatic latent image with the toner, so that a toner image is formed. Here, the exposure head 106 is an elongated head. The exposure head 106 is disposed so that a longitudinal direction of the exposure head 106 and a rotational axis direction of the photosensitive drum 102 coincide with each other. However, "coincide with each other" referred to herein does not mean that the longitudinal direction of the exposure head 106 and the rotational axis direction of the photosensitive drum 102 are strictly parallel to each other. It permits that these directions are somewhat inclined relative to each other due to component part tolerance.

A transfer belt 406 is an endless belt which is provided between a sheet (paper) feeding cassette 408 and the respective photosensitive drums 102 and which is rotatable in an arrow direction (clockwise direction) in the figure while being stretched by a plurality of rollers. Further, at positions facing the photosensitive drums 102, transfer rollers are provided inside the transfer belt 406 so as to sandwich the transfer belt 406 between the transfer rollers and the photosensitive drums 102. The toner images formed on the photosensitive drums 102 of the process cartridges are transferred onto the transfer belt 406 contacted to the photosensitive drums 102 by the transfer rollers, whereby the respective color toner images are superposed on the transfer belt 406, so that a full-color toner image is formed.

On the other hand, in synchronism with the image formation of the respective process cartridges of the casing 400, a sheet S is fed from the sheet feeding cassette 408 of the sheet feeding/conveying portion 405 and is conveyed toward a secondary transfer device 407. In the secondary transfer device 407, the toner images on the transfer belt 406 are transferred onto the fed sheet S. Then, the sheet S on which the toner images are transferred is conveyed to a fixing portion 404 by a conveying belt 412. In the fixing portion 404, unfixed toner images on the conveyed sheet S are pressed and heated, so that the toner images are fixed on the sheet S. Thereafter, the sheet S is conveyed in a conveying passage and is discharged onto a discharge tray 409.

Part (b) of FIG. 1 is a sectional view showing a state in which the casing 400 is drawn out of the printer 100. Thus, the image forming apparatus in this embodiment includes an apparatus main assembly (printer 100) and the casing 400 which is capable of being mounted in and drawn out of the apparatus main assembly. That is, the printer 100 referred to herein refers to a portion, of the image forming apparatus, other than the casing 400. Part (b) of FIG. 1 shows a state in which the casing 400 is drawn out of the printer 100 through an opening to an outside of the image forming apparatus. The opening appears by movement of the door 410, provided rotatably as shown in part (a) of FIG. 1, from a closed state to an open state. The door 410 is an openable door for permitting access to an inside of the casing 400 in order to draw out the casing 400 from the apparatus main assembly substrate 500. When the door 410 is in the closed state, the opening is covered with the door 410. On the other hand, when the door 410 is in the open state, the opening is open, so that through this opening, an operation for mounting the casing 400 in the apparatus main assembly and for drawing-out the casing 400 from the apparatus main assembly can be performed. In the image forming apparatus of this embodiment, rail members (not shown) on which the casing 400 is mounted are provided along a mounting direction of the casing 400 in order to facilitate a mounting and drawing-out operation of the casing 400. The casing 400 is mounted on the rail members and is guided by the rail members, so that the casing 400 is movable inside the image forming apparatus. Further, when the opening operation of the door 410 is performed, by an unshown mechanism, the photosensitive drums 102 of the respective process cartridges are spaced from the transfer belt 406. Similarly, the exposure heads 106 are also moved in an upward direction (top surface direction) by an unshown mechanism, and are spaced from the photosensitive drums 102 of the process cartridges. On the other hand, when the closing operation of the door 410 is performed, the exposure heads 106 are moved in a downward direction (bottom direction) by the unshown mechanism to positions where the surfaces of the photosensitive drums 102 of the respective process cartridges are exposed to light by the exposure heads 106.

Part (c) of FIG. 1 is a sectional view showing a state in which the process cartridge for yellow (Y) is dismounted from the casing 400. The process cartridge in this embodiment is prepared by integrally assembling the photosensitive drum 102, the charging device 402 and the developing device 403 into a unit, and has a constitution in which the process cartridge is easily dismounted from the casing 400 and can be exchanged with new one.

[Structure of Light Exposure Head]

Figure 2:
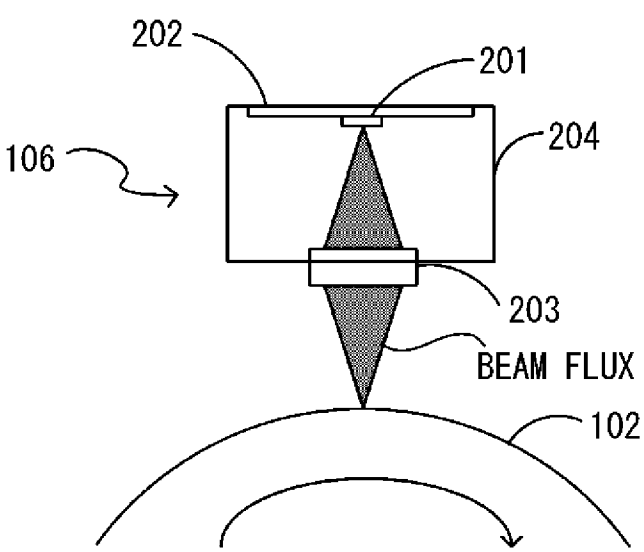
Figure 2:
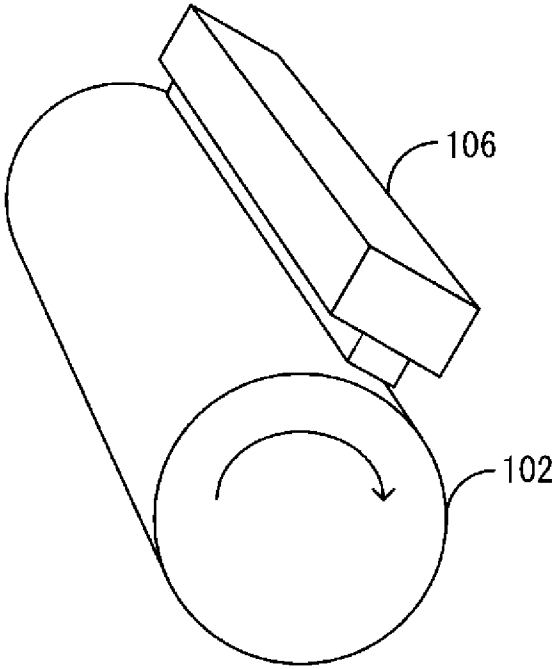

Next, the exposure head 106 for performing the exposure of the photosensitive drum 102 to light will be described using FIG. 2. Part (a) of FIG. 2 is a perspective view showing a positional relationship between the exposure head 106 and the photosensitive drum 102, and part (b) of FIG. 2 is a schematic view for illustrating an internal structure of the exposure head 106 and a state in which a beam flux from the exposure head 106 is concentrated at the photosensitive drum 102 by a rod lens array 203. As shown in part (a) of FIG. 2, the exposure head 106 is mounted in the casing 400 (FIG. 1) by a mounting member (not shown) at a position which is above the photosensitive drum 102 rotating in an arrow direction and where the exposure head 106 opposes the photosensitive drum 102.

As shown in part (b) of FIG. 2, the exposure head 106 is constituted by a driving substrate 202, a surface emitting element array element group 201 mounted on the driving substrate 202, the rod lens array 203 and a housing 204. To the housing 204, the rod lens array 203 and the driving substrate 202 are mounted. The rod lens array 203 concentrates a beam flux (light flux), from the surface emitting element array element group 201, onto the photosensitive drum 102. In a factory, an assembling adjustment operation of the exposure head 106 alone is performed, so that focus adjustment and light intensity adjustment of each of spots are carried out. Here, the assembling adjustment is carried out so that a distance between the photosensitive drum 102 and the rod lens array 203 and a distance between the rod lens array 203 and the surface emitting element array element group 201 are predetermined intervals (distances). As a result, the light from the surface emitting element array element group 201 is formed on the photosensitive drum 102. For that reason, during focus adjustment in the factory, a mounting position of the rod lens array 203 is performed so that the distance between the rod lens array 203 and the surface emitting element array element group 201 is a predetermined value. Further, during light intensity adjustment in the factory light emitting elements of the surface emitting element array element group 201 are successively caused to emit light, and adjustment of a driving current of each of the light emitting elements is carried out so that the light concentrated at the surface of the photosensitive drum 102 via the rod lens array 203 has a predetermined light intensity.

[Structure of Surface Emitting Element Array Element Group]

FIG. 3 is a schematic view for illustrating the surface emitting element array element group 201. Part (a) of FIG. 3 is a schematic view showing a structure of a surface (first surface) of the driving substrate 202 on which the surface emitting element array element group 201 is mounted, and part (b) of FIG. 3 is a schematic view showing a structure of a surface (second surface) of the driving substrate 202 opposite from the first surface on which the surface emitting element array element group 201 is mounted.

As shown in part (a) of FIG. 3, the surface emitting element array element group 201 has a constitution in which 29 surface emitting element array chips 1 to 29 are arranged in two rows in a staggered shape along a longitudinal direction of the driving substrate 202. Incidentally, in part (a) of FIG. 3, an up-down direction shows a sub-scan direction (rotational direction of the photosensitive drum 102) which is a first direction, and a horizontal direction shows a main scan direction which is a second direction perpendicular to the sub-scan direction. The main scan direction is also a direction crossing the rotational direction of the photosensitive drum 102. Each of elements of the surface emitting element array element group 201 having 516 light emitting points in total is arranged with a predetermined resolution pitch in a longitudinal direction of the surface emitting element array chips. In this embodiment, the pitch of each element of the surface emitting element array chips is about 21.16 μm (≈2.54 cm/1200 dots) which is a pitch of a resolution of 1200 dpi which is a first resolution. As a result, an end-to-end interval of the 516 light emitting points in one (single) surface emitting element array chip is about 10.9 mm (≈21.16 μm×516). The surface emitting element array element group 201 is constituted by 29 surface emitting element array chips. The number of light emitting elements, of the surface emitting element array element group 201, capable of exposing the photosensitive drum to light is 14,964 elements (=516 elements×29 chips), so that image formation corresponding to an image width of about 316 mm (≈1.0 mm×28 chips) with respect to the main scan direction.

Part (c) of FIG. 3 is a schematic view showing a state of a boundary between chips of the surface emitting element array chips disposed in the two rows along the longitudinal direction, and the horizontal direction is the longitudinal direction of the surface emitting element array element group 201 of part (a) of FIG. 3. As shown in part (a) of FIG. 3, at an end portion of the surface emitting element array chips, wire bonding pads to which a control signal is inputted are provided, and by a signal inputted from the wire bonding pads, a transfer portion and the light emitting elements are driven. Further, the surface emitting element array chips include a plurality of light emitting elements. The plurality of light emitting elements are arranged along the rotational axis direction of the photosensitive drum 102. Even at a boundary between the surface emitting element array chips, a pitch (an interval between center points of two light emitting elements) of the light emitting elements with respect to the longitudinal direction is about 21.16 μm which is a pitch of the resolution of 1200 dpi. Further, the surface emitting element array chips arranged in upper and lower (two) rows are disposed so that an interval between light emitting points of the upper and lower surface emitting element array chips (indicated by double-pointed arrow S) is about 84 μm (a distance which is an integral multiple of each resolution corresponding to 4 pixels in 1200 dpi, i.e., 8 pixels in 2400 dpi).

Further, as shown in part (b) of FIG. 3, on the surface of the driving substrate 202 opposite from the surface on which the surface emitting element array element group 201 is mounted, driving portions 303*a* and 303*b* and a connector 305 are mounted. The driving portions 303*a* and 303*b* disposed on both sides of the connector 305 drive the surface emitting element array chips 1 to 15 and the surface emitting element array chips 16 to 29, respectively. The driving portions 303*a* and 303*b* are connected to the connector 305 via patterns 304*a* and 304*b*, respectively. To the connector 305, signal lines for controlling the driving portions 303*a* and 303*b*, and a power source voltage and the ground are connected, and are connected to the driving portions 303*a* and 303*b*. Further, from each of the driving portions 303*a* and 303*b*, wiring for driving the surface emitting element array element group 201 passes through an inner layer of the driving substrate 202 and is connected to the surface emitting element array chips 1 to 15 and the surface emitting element array chips 16 to 29. Incidentally, in this embodiment, each of the light emitting elements is a semiconductor light emitting diode (LED), but for example, may also be an organic light emitting diode (OLED). This OLED is also called organic electroluminescent (EL) device (element) and is a light emitting element of a current-driving type. The OLED is disposed on, for example, a thin film transistor (TFT) in a line along the main scan direction. A plurality of OLEDs are electrically connected in parallel with each other by power source wiring provided similarly along the main scan direction.

[Control Constitution of Main Assembly Substrate Control Substrate and Light Exposure Head]

FIG. 4 is a block diagram for illustrating a control constitution of the main assembly substrate 500, the LED control substrate 501, and driving substrates 202 (202Y, 202M, 202C, 202K) mounted on the respective exposure heads 106 (106Y, 106M, 106C, 106K). The main assembly substrate 400 which is a control substrate is a print substrate provided with a control circuit for controlling the printer 100 during image formation, and includes a main CPU 510 for controlling the image formation and an image controller 503. When the image controller 503 receives an image formation instruction from the main CPU 510, the image controller 503 outputs image data (an example of a driving signal) for forming images to the LED emission controller 504 of the LED control substrate 501. In the image data, pixel data corresponding to each of the surface light emitting elements of the surface emitting element array chips 1 to 29 mounted on the driving substrate 202 of each of the exposure heads 106 are included. Then, the image controller 503 outputs the image data to the LED emission controller 504 in a predetermined order. Incidentally, on the main assembly substrate 500, various control circuits for controlling the image formation are provided, but in this embodiment, only the control circuit relating to the control of the exposure heads 106 is described, and other control circuits will be omitted from description.

Further, the LED control substrate 101, which is a relay substrate, includes an LED emission controller 504. The LED emission controller 504 receives the image data outputted from the image controller 503 of the main assembly substrate 500, and on the basis of the received image data, generates irradiation data corresponding to the respective surface light emitting elements of the surface emitting element array chips 1 to 29 mounted on the exposure heads 106. The image data from the image controller 503 includes color information on whether or not the image data is for which color of yellow (Y), magenta (M), cyan (C) and black (K). On the basis of the color information, the LED emission controller 504 outputs the irradiation data of the photosensitive drums 102 corresponding to the respective colors to the driving substrates 202 of the exposure heads 106 on which the surface emitting element array chips for the respective colors are mounted. The driving portions 303*a* and 303*b* mounted on each of the driving substrates 202 of the exposure heads 106 carry out turning-on control of the surface light emitting elements on the basis of the irradiation data received from the LED emission controller 504, so that the photosensitive drums 102 are exposed to light.

Further, the LED control substrate 501 also has the function as the relay substrate for electrically connecting the main assembly substrate 500 and the driving substrates 202 of the exposure heads 106. Specifically, as shown in FIG. 4, between the LED control substrate 501 and the driving substrates 202 (202Y, 202M, 202C, 202K), cables 505 (505Y, 505M, 505C, 505K) are independently connected, respectively. Then, via the cables 505, from the LD control substrate 501 to the driving substrates 202 of the exposure heads 106, signals, which are irradiation data, such as a serial signal, a power source voltage signal and a grounding signal are transmitted. Further, between the main assembly substrate 500 and the LED control substrate 501, a cable 520 which is a flexible flat cable is provided and connects these substrates. Further, in order to transmit transmitting signals via the cable 520, 10 signal wires in total for transmitting image data through serialization/deserialization (Ser/Des) of image data for the respective colors are used. The 10 signal wires includes 4 pairs (2 wires×4) of differential signal wires of yellow (Y), magenta (M), cyan (C) and black (K), a power source voltage signal wire (1 wire) and a grounding signal wire (1 wire).

[Capable Connection Structure Between Main Assembly Substrate and LED Control Substrate]

FIG. 5 is a schematic view of the printer 100 in a state in which the casing 400 is accommodated, as seen from a side surface. FIG. 5 is the schematic view for illustrating a positional relationship between the main assembly substrate 500 and the LED control substrate 501, and a connection structure of the cable 520 for electrically connecting the main assembly substrate 500 and the LED control substrate 501. Incidentally, the main assembly substrate 500 is provided on a guiding member 506L (FIG. 6) described later, but the guiding member 506L is not shown in FIG. 5.

The LED control substrate 501 is provided on a side wall (on the front side of the drawing sheet in the figure) at a "RR" end portion of the side wall. On the other hand, the main assembly substrate 500 is disposed on the guiding member 506L, but compared with the LED control substrate 501, the main assembly substrate 500 is disposed at a position close to the bottom of the casing of the printer 100. Further, the main assembly substrate 500 includes a connector 540 for connecting the cable 520, and the LED control substrate 501 includes a connector 530 for connecting the cable 520.

Next, connection between the main assembly substrate 500 and the LED control substrate 501 by the cable 520 which is the flat cable will be described. The cable 520 connected to the connector 540 of the apparatus main assembly substrate 500 extends in the "RR" direction in the figure from the connector 540 of the main assembly substrate 500, and thereafter is folded back at a fold-back point 522, and then extends in the "U" direction in the figure. Thereafter, the cable 520 is folded back at a fold-back point 523 and then extends in the "RR" direction. Thereafter, the cable 520 extended in the "RR" direction is, as shown in FIG. 6 described later, bent in an arcuate shape in the rearward direction on the drawing sheet, and thus is connected to the connector 530 of the LED control substrate 501.

[Shape of Cable Connecting Main Assembly Substrate and LED Control Substrate]

Parts (a) and (b) of FIG. 6 are schematic views showing a shape of the cable 520 connecting the main assembly substrate 500 and the LED control substrate 501, as seen from above. Part (a) of FIG. 6 is the support showing a state in which the casing 400 is accommodated in the printer 100, and part (b) of FIG. 6 is the schematic view showing the shape of the cable 520 in the case where the casing 400 is drawn out of the printer 100. Incidentally, in parts (a) and (b) of FIG. 6, "FR" (right side on the drawing sheet) is the frontward direction of the printer 100, and the "RR" (left side on the drawing sheet) is the rearward direction of the printer 100. Further, "L" is the leftward direction as seen from the front side of the printer 100, and "R" is the rightward direction as seen from the front side. Incidentally, as in FIGS. 7, 8 and part (a) of FIG. 9, the directions indicated by "FR", "RR", "U" and "D" are similar to those described above, and will be omitted from description with reference to FIGS. 7, 8 and part (a) of FIG. 9.

In part (a) of FIG. 6, an outer periphery of the casing 400 is surrounded by side walls. Of the side walls of the casing 400, a side wall 400SR (second wall portion or first wall portion) is the side wall on the "R" side in the figure, and a side wall 400SL (first wall portion or second wall portion) is the side wall on the "L" side in the figure. Further, the side wall (third wall portion) which is a rear wall portion is the side wall of the casing 400 on the "RR" side in the figure, i.e., on the upstream side with respect to the drawing-out direction of the casing 400. In other words, the third wall portion is the side wall of the casing 400 which is continuously formed between a rear-side end portion of the first wall portion and a rear-side end portion of the second wall portion. Incidentally, the front-rear direction referred to herein coincides with the movement direction of the casing 400 when the casing 400 is drawn out of and mounted in the printer 100.

When a position where the casing 400 is mounted in the printer 100 is a mounted position and a position where the casing 400 is drawn out of the printer 100 is a drawn-out position, a direction in which the casing 400 moves from the mounted position toward the drawn-out position is a drawing-out direction. The drawn-out position is a position where the casing 400 is drawn out to the extent that a user is capable of performing an exchanging operation of the process cartridge. Specifically, a position where the casing 400 is drawn out of the printer 100 through an opening provided in the printer 100 and the exposure head 106Y for yellow (Y) is exposed through the opening and thus the user has access to the exposure head 106Y is defined as the drawn-out position. The third wall portion of the casing 400 is continuous to both the upstream end portion of the first wall portion and the upstream end portion of the second wall portion with respect to the drawing-out direction of the casing 400 from the printer 100. Thus, the third wall portion forms a wall surface of the casing 400 in cooperation with the first wall portion and the second wall portion. Incidentally, the above-described connector 530 projects further toward the upstream side with respect to the drawing-out direction than the third wall portion projects, on a side where the connector 530 is connected to the cable 520. Further, as shown in parts (a) and (b) of FIG. 6, it is understood that the cable 520 extends from the LED control substrate 501 in an opposite direction to the drawing-out direction.

Further, in this embodiment, the LED control substrate 501 is provided on the side wall 400SL at the "RR"-side end portion. Between the casing 400 and the casing of the printer 100, the guiding members 506, which are fixed to the casing of the printer 100, for guiding drawing-out and accommodation of the casing 400 are provided. The guiding members 106 which are examples of facing portions are a pair of guiding members provided on the "R" and "L" sides in the figure, in which the guiding member 506 on the "R" side is a guiding member 506R and the guiding member 506 on the "L" side is the guiding member 506L. A first facing portion corresponds to the guiding member 506R, and a second facing portion corresponds to the guiding member 506L.

In FIG. 6, the guiding member 506L is provided with an opening 507 through which the cable 520 extending from the LED control substrate 501 toward the main assembly substrate 500 passes. The cable 520 is sandwiched at this opening 507 portion and thus is fixed to the guiding member 506L. Incidentally, a fixing method is not limited to a constitution of sandwiching the cable 520, but may also be a method of bonding the cable 520 with an adhesive or the like. The main assembly substrate 500 is provided to the printer 100 on a side opposite, with respect to the guiding member 506L, from the side where the guiding member 506R is disposed. Thus, when the LED control substrate 501 is provided on the side wall 400SL (first wall portion), the main assembly substrate 500 is fixed to the printer 100 on the side where the guiding member 506L (first facing portion) is disposed. On the other hand, when the LED control substrate 501 is provided on the side wall 400SR (second wall portion), the main assembly substrate 500 is fixed to the printer 100 on the side where the side wall 400SR (second facing portion) is disposed. Thus, a device such that a length connecting the LED control substrate 501 and the main assembly substrate 500 is shortened to the extent possible is made.

The cable 520 passes through the opening 507 and connects the connector 540 of the main assembly substrate 500 and the connector 530 of the LED control substrate 501. Incidentally, in the case where the casing 400 is drawn out of and inserted into the printer 400, the opening is provided at a position where a distance from the opening 507 to the LED control substrate 501 is the same. For that reason, the position of the opening 507 is disposed further toward the "RR" side in the figure than the apparatus main assembly substrate 500 is, and in other words, when the casing 400 is in the mounted position, the opening 507 is formed in the guiding member 506L on a side downstream of the third wall portion with respect to the drawing-out direction. Further, the position of the opening 507 is disposed further toward the "FR" side in the figure than the LED control substrate 501 is. Further, the position of the guiding member 506L in the figure is further toward the "RR" side than the position of the side wall 400R of the casing 400 is. Further, the LED control substrate 501 and the exposure heads 106 (106Y, 106M, 106C, 106K) are connected with each other via the cables 505 (505Y, 505M, 505C, 505K), respectively.

In part (a) of FIG. 6, the cable 520 extending from the connector 540 of the main assembly substrate 500 passes through the opening 507 and enters a space sandwiched between the side wall 500SL of the casing 400 and the guiding member 506L. Then, the cable 520 extends from the opening 507 to the "RR" end of the guiding member 506L in the figure so as to stick to the guiding member 506L along the 506L facing the side wall 400SL of the casing 400. Then, the cable 520 forms an arcuate curved portion as shown in part (a) of FIG. 6 depending on a length (hereinafter referred to as an excessive length (portion)) of the cable 520 from the "RR" end of the guiding member 506L to the connector 530 provided on the LED control substrate 501. Here, the excessive length refers to, of a length of the cable 520 from the opening 507 to the LED control substrate 501, a length of a portion longer than a distance from the opening 507 to the LED control substrate 501 (part (a) of FIG. 10). The excessive length portion is provided so as to not only extend along the movement direction of the casing 400 but also permit movement of the casing 400. The arcuate curved portion formed by the excessive length of the cable 520 is formed at the following position. That is, the curved portion is formed between a surface of the side wall 400R of the casing 400 on a side opposite from the side of the side wall 400R facing the opening side of the casing 400 which is opened and closed by the door 410 of the printer 100. Further, the curved portion is formed at an inside position (space) sandwiched by extended portions, of the facing side walls 400SR and 400SL of the casing 400 in the "RR" direction. For example, a position of a center 520C of a circle, with respect to the "L" and "R" directions when the curved portion shown in part (a) of FIG. 6 is regarded as the circle is inside extended lines of the facing side walls 400SR and 400SL of the casing 400 in the "RR" direction. Incidentally, with a shorter excessive length, a radius of the curved portion (bending radius) becomes smaller, so that durability of the cable 520 is lowered. For that reason, in the case where the casing 400 is accommodated in the printer 100, there is a need that the cable 520 has an excessive length such that the curved portion having a bending radius of a predetermined radius or more is formed. Further, in the case where the excessive length of the cable 520 is excessively long, for example, a part of the formed curved portion contacts the casing of the "RR"-side casing of the printer 100 facing the side wall 400R and a feeding passage along which the sheet S is conveyed, in some instances. For that reason, there is a need that the excessive length of the cable 520 does not exceed a certain length. Incidentally, in this embodiment, the predetermined radius is larger than half of a distance between the side wall 400SL of the casing 400 and the guiding member 506L and half of a distance between the side wall 400SR of the casing 400 and the guiding member 506R.

Thus, when the casing 400 is in the mounted position, a width of the cable with respect to the left-right direction (longitudinal direction of the exposure head 106) on the side upstream of the side wall 400R with respect to the drawing-out direction is wider (larger) than a distance between the side wall 400SL and the guiding member 506L. This is because stiffness of the cable 520 presses and extends the folded-back cable 520. Thus, it is possible to suppress that a load is exerted on the cable 520 more than necessary by the mounting and drawing-out operation of the casing 400.

On the other hand, part (b) of FIG. 6 shows a state in which the casing 400 is drawn out of the printer 100. In this case, the cable 520 is moved by the connector 530 on the LED control substrate 501 depending on movement of the casing 400 in the "FR" direction in the figure. As a result, the cable 520 from an arcuate curved portion, in the space in which the casing 400 has been accommodated in the printer 100, has a bending radius larger than the bending radius thereof in the state in which the casing 400 is accommodated in the printer 100. This is because of the length from the opening 507 to the connector 530, a length in which the cable 520 is not constrained by the guiding member 506L and is capable of being changed in shape is made longer than the excessive length in the case of part (a) of FIG. 6 and therefore a force for returning the shape of the cable 520 to the original shape acts on the cable 520.

As described above, by drawing-out of the casing 400 from the printer 100 and inserting the casing 400 into the printer 100, the cable 520 is bent, so that a load is applied to the cable 520. In general, the flat cable used as the cable 520 has a durable lifetime characteristic against bending, and when the flat cable is bent not less than the number of times of the lifetime, the flat cable causes breakage thereof in some cases. For that reason, the flat cable used as the cable 520 should be selected on the basis of the number of times of durability satisfying the number of times of drawing-out and insertion of the casing 400. Further, bending durability of the flat cable becomes long in terms of durability lifetime when the bending radius of the curved portion shown in part (a) of FIG. 6 is larger than the predetermined bending radius. For this reason, the curved portion formed by the excessive length of the cable 520 is formed not only between the side wall 400R and the casing of the printer 100 facing the side wall 400R, but also in the inside position (space) between the extended lines of the side walls 400SR and 400SL, whereby a large bending radius can be ensured. As a result, the cable 520 can satisfy the bending durability.

[Shape of Cable in Case that LED Control Substrate is Provided at Rear Portion of Casing]

In FIG. 6, the shape of the cable 520 in the case where the LED control substrate 501 is provided on the side wall 400SL of the casing 400 was described. FIG. 7 is a schematic view for illustrating the shape of the cable 520 in the case where the LED control substrate 501 is provided on a surface (surface of the side wall 400R (third wall portion) on a side opposite from the side facing the opening which is opened and closed by the door 410) of the side wall 400R of the casing 400 facing the casing of the printer 100. In FIG. 7, the LED control substrate 501 is provided at an end portion of the side wall 400R on a side close to the guiding member 506L where the main assembly substrate 500 is provided. For that reason, a constitution in which the cables 505 (505Y, 505M, 505C, 505K) for connecting the exposure heads 106 (106Y, 106M, 106C, 106K) and the LED control substrate 501 extend from a remote side of the connector 530 from the guiding member 506. This is because formation of the bent portion with a small bending radius at an outlet of the connector 530 in the case where the cable 520 forms the arcuate curved portion when the cable is connected to the connector 530 on a side close to the guiding member 506L is avoided.

Thus, also in the case where the LED control substrate 501 is provided on the side wall 400R of the casing 400, the position of the center 520C of the arcuate curved portion drawn by the cable 520 is similar to that in the case of part (a) of FIG. 6. That is, the center 520C of the arcuate curved portion drawn by the cable 520 is positioned not only at the rear of the side wall 400R of the casing 400 but also inside the extended lines of the facing side walls 400SR and 400SL of the casing 400. For that reason, similarly as in FIG. 6, the cable 520 can ensure a sufficiently large bending radius at the curved portion and can satisfy the bending durability.

[Other Shapes of Cable Connecting Main Assembly Substrate and LED Control Substrate]

FIG. 8 is a schematic view similar to part (a) of FIG. 6 described above, but is different from part (a) of FIG. 6 in that a fold 520B is provided to the cable 520 in the neighborhood of the connector 530. The fold 520B is provided in the cable 520 so as to be positioned further toward the rear side of the printer 100 than the side wall 400R (third wall portion) is. In other words, with respect to the drawing-out direction of the casing 400, the cable 520 is provided with the fold 520B on the side upstream of the side wall 400R. The flat cable used as the cable 520 is a cable which has elasticity and on which a force for returning the shape of the flat cable to the original shape acts, but has a property such that the flat cable is liable to be bent at the fold as a fulcrum, for example, by providing the fold at which the flat cable is bent 90 degrees. For that reason, as shown in FIG. 8, by providing the cable 520 with the fold such as the fold 520B in the neighborhood of the connector 530 on the LED control substrate 501, the bending radius of the curved portion of the cable 520 can be made larger than the bending radius in the case of part (a) of FIG. 6. As a result, the bending durability can be further improved.

By providing the cable 520 with the fold 520B, the bending radius of the cable 520 can be made larger, but on the other hand, when the casing 400 is drawn out of and inserted into the printer 100, the fold 520B provided to the cable 520 is repetitively bent. For that reason, there is an increasing possibility that the cable 520 is broken. Therefore, parts (a) and (b) of FIG. 9 are schematic views of a constitution in which a fixing member 521 for fixing the cable 520 is provided for preventing breakage of the cable 520 in the constitution shown in FIG. 8. Part (a) of FIG. 9 is the schematic view in the case where the printer 100 is seen from above, and part (b) of FIG. 9 is an enlarged perspective view showing a neighborhood of the fixing member 521. Incidentally, in part (b) of FIG. 9, "FR" is the frontward direction of the printer 100, "RR" is the rearward direction of the printer 100, "U" is the top (upward) direction of the printer 100, and "D" is the bottom (downward) direction of the printer 100. Further, "L" is the leftward direction of the printer 100 as seen from the front side, and "R" is the rightward direction of the printer 100 as seen from the front side. As shown in parts (a) and (b) of FIG. 9, the fixing member 521 is disposed in the neighborhood of the end portion of the side wall 400R of the casing 400 on a side close to the side wall 400SL on which the LED control substrate 501 is provided. By providing the fixing member 521, a force exerted on the fold 520B when the cable 520 forms the arcuate curved portion can be reduced, with the result that breakage of the cable 520 can be prevented.

As described above, by employing the cable connection structure depending on an installation place of the LED control substrate 501, it is possible to compatibly realize maintenance of durability of the flat cable and downsizing of the image forming apparatus which are problems of a conventional cable connection structure. Incidentally, in the above-described embodiment, the apparatus main assembly substrate 500 was provided on the guiding member 506L provided on the "L" side of the printer 100, but the present invention is not limited to the guiding member 506L, and the main assembly substrate 500 may also be provided on the "R" side. In that case, an installation position of the LED control substrate 501 is, for example, on the side wall 400SR of the casing 400 or the end portion of the side wall 400R facing the guiding member 506R depending on the installation position of the main assembly substrate 500.

As described above, according to this embodiment, durability of the flat cable connecting the main assembly substrate and the LED control substrate can be prevented from lowering.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-202900 filed on Oct. 29, 2018, which is hereby incorporated by reference herein in its entirety.

What is claimed is:

1. An image forming apparatus comprising:

a main assembly; and a drawer unit movable between a mounted position where said drawer unit is mounted in said main assembly and a drawn-out position where said drawer unit is drawn out of the mounted position, wherein said drawer unit comprises:

a rotatable photosensitive drum, an optical print head including a light emitting element configured to expose said photosensitive drum to light, first, second and third wall portions, wherein said first wall portion supports one end side of said optical print head with respect to a longitudinal direction of said optical print head, said second wall portion supports the other end side of said optical print head with respect to the longitudinal direction, and said third wall portion is continuously formed between an upstream end portion of said first wall portion and an upstream end portion of said second wall portion with respect to a drawing out direction of said drawer unit from the mounted position toward the drawn-out position to form a wall portion in cooperation with said first wall portion and said second wall portion, and a relay substrate provided on either one of an outer surface of said first wall portion and an outer surface of said second wall portion with respect to the longitudinal direction and configured to relay a signal for driving said optical print head, wherein said main assembly comprises:

a first facing portion provided on a side opposite from a side facing said second wall portion and configured to face said first wall portion, a second facing portion provided on a side opposite from a side facing said first wall portion and configured to face said second wall portion, and a main assembly substrate configured to generate a driving signal for driving said light emitting element, wherein said relay substrate and said main assembly substrate are connected by a cable, and when said drawer unit is in the mounted position, said cable extends from said relay substrate in an opposite direction to the drawing-out direction and is folded back in the drawing-out direction on a side downstream of said third wall portion with respect to the opposite direction and then is connected to said main assembly substrate through an opening provided in one of said first facing portion and said second facing portion, facing said relay substrate on a side downstream of said third wall portion with respect to the drawing-out direction, and wherein said cable folded back includes portions with respect to the longitudinal direction on a side upstream with respect to the drawing-out direction, wherein a distance between said portion of said cable before being folded back and said portion of said cable after being folded back is longer than a distance, with respect to the longitudinal direction, between said first or second wall portion on which said relay substrate is provided and said first or second facing portion facing said first or second wall portion on which said relay substrate is provided.

2. An image forming apparatus according to claim 1, wherein said relay substrate includes a connector to which said cable is connected, and wherein said connector projects toward a side upstream of said third wall portion with respect to the drawing-out direction on a side where said connector is connected to said cable.

3. An image forming apparatus according to claim 1, wherein said cable extending in the opposite direction is bent along said third wall portion.

4. An image forming apparatus according to claim 3, further comprising a fixing member configured to fix said cable to said third wall portion, wherein said fixing member is provided on said third wall portion.

5. An image forming apparatus according to claim 1, wherein said opening is formed in said first facing portion or said second facing portion so as to be positioned on a side upstream of said third wall portion with respect to the drawing-out direction when said drawer unit is in the drawn-out position.

6. An image forming apparatus according to claim 1, wherein a part of said cable is sandwiched by said opening.

7. An image forming apparatus according to claim 1, wherein said cable is a flat cable.

8. An image forming apparatus according to claim 1, wherein said optical print head is provided above said photosensitive drum with respect to a vertical direction.

9. An image forming apparatus according to claim 1, wherein said drawer unit includes a plurality of optical print heads, and wherein said optical print heads are arranged in the drawing-out direction.

10. An image forming apparatus according to claim 1, wherein said light emitting element is a light emitting diode.

11. An image forming apparatus according to claim 1, wherein said light emitting element is an organic light emitting diode.

* * * * *